United States Patent [19]

Rabinow et al.

[11] 4,024,998

[45] May 24, 1977

[54] ROCKET

[75] Inventors: Jacob Rabinow, Washington, D.C.; William Hunter A. Boyd, Kensington, Md.

[73] Assignee: The United States of America as represented by the Secretary of the Army, Washington, D.C.

[22] Filed: Mar. 7, 1956

[21] Appl. No.: 570,190

[52] U.S. Cl. ..... 244/3.26

[51] Int. Cl.² ..... F42B 15/10

[58] Field of Search ..... 102/50, 49; 244/3.26

[56] References Cited

UNITED STATES PATENTS

| | | | |
|---|---|---|---|
| 2,344,957 | 3/1944 | Anzalone | 102/50 |
| 2,409,904 | 10/1946 | Schermuly | 102/50 |
| 2,437,211 | 3/1948 | Schermuly | 102/50 |
| 2,470,489 | 5/1949 | Hopkins | 102/49 |

*Primary Examiner*—Verlin R. Pendegrass
*Attorney, Agent, or Firm*—Nathan Edelberg; Robert P. Gibson; Saul Elbaum

EXEMPLARY CLAIM

1. A slidable fin assembly in combination with a rocket adapted to be launched motor-first with respect to the air, said rocket having a motor at one end and a warhead at the other end, said fin assembly comprising a tube encircling the body of said rocket and adapted to be longitudinally slidable thereon, a plurality of fins symmetrically mounted to said tube, each of said fins having an airfoil cross section which is asymmetric about its chord so that the lift of said fins acts to spin the rocket in the same direction about its longitudinal axis whether the rocket is traveling motor-first with respect to the air or warhead-first with respect to the air, said slidable fin assembly being initially located at the warhead end of the rocket so that said fins provide stabilization as the rocket initially travels motor-first with respect to the air, air-responsive lock means adapted to cooperate with said fin assembly and said rocket so that said lock means holds said fin assembly at the warhead end of the rocket while the rocket travels motor-first with respect to the air and unlocks said fin assembly when the thrust of the rocket motor causes the rocket to stop and reverse directions, said fin assembly in response to the aerodynamic forces on said fins thereupon longitudinally sliding to the motor end of the rocket so that the fins now provide stability as the rocket travels warhead-first with respect to the air, and means on said rocket for engaging and maintaining the fin assembly in position at the motor end after sliding thereto, the spin of the rocket caused by the lift of the fins providing stability for both directions of travel of the rocket and also during the period when the rocket is not in motion.

1 Claim, 5 Drawing Figures

INVENTOR
Jacob Rabinow
William Hunter A. Boyd
BY
W. E. Thibodeau, A. W. Dew & J. P. Edgerton
ATTORNEYS.

INVENTOR
*Jacob Rabinow*
*William Hunter A. Boyd*

BY
*W. E. Thibodeau, A. W. Dew & J. D. Edgerton*
ATTORNEYS

ROCKET

The invention described herein may be manufactured and used by or for the Government for governmental purposes without the payment to us of any royalty thereon.

This invention relates to rearwardly fired aircraft rockets and means to prevent them from tumbling.

It is obviously desirable that military aircraft be able to fire rockets to the rear. However, with fin-stabilized rockets known to the present art, this is not possible because, on release, the rocket is momentarily traveling at the speed of the aircraft, fin first. Before the acceleration due to the rocket motor reverses the direction of travel, the rocket will have tumbled or deviated from its original path.

Prior attempts to solve this tumble problem have included projecting the rocket at a relative velocity greater than that of the plane so the rocket always travels in the air warhead end first; however, this necessitates undesirably heavy launching equipment. Another solution was to stabilize the rocket by spinning rather than stabilizing by fins; this necessitates complicated and therefore unreliable mehanism to produce this spin before the rocket leaves the guiding influence of the plane.

The present invention overcomes this problem by providing, in a typical embodiment, a set of sliding fins of novel design that are initially — while the rocket is moving motor end first — at the warhead end of the rocket. When the direction of the rocket with respect to the air reverses, the fins automatically slide to the conventional position at the motor end.

A principal object of the invention is to provide a rocket that will follow a straight course when fired rearwardly from an aircraft.

Another object is to provide a rocket having sliding fins that are locked at the warhead end of the rocket when the rocket is fired rearwardly from an aircraft, the fins automatically moving to the motor end when the direction of rocket motion with respect to the air reverses.

Another object is to provide a rocket fin design that will cause the rocket to rotate in only one direction, regardless of whether the rocket is moving motor end or warhead end first with respect to the air.

A further object is to accomplish the above with a simple, rugged, reliable and economical device which is readily adaptable to present rockets.

The specific nature of the invention as well as other objects, uses and advantages thereof will clearly appear from the following description and from the accompanying drawings, in which:

FIG. 1 is a side elevation of an aircraft with a rocket of the invention:

a. as first launched, b. as it reverses direction, and c. as it gains speed in the final direction.

Figure 1:
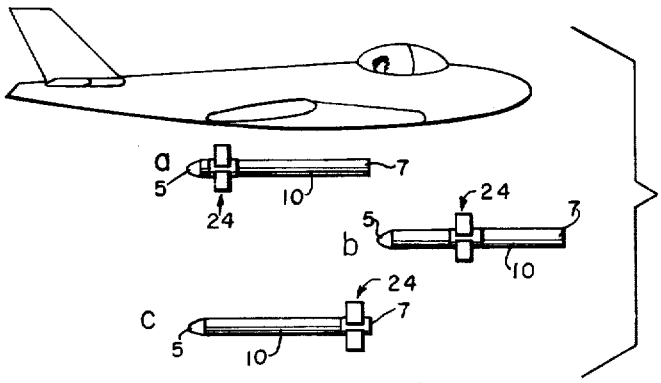
Figure 2:
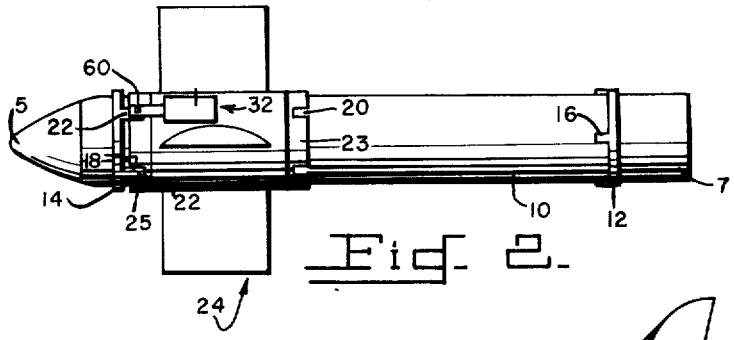
FIG. 2 is a side elevation of the fin assembly on a rocket.

In the figures, rocket 10 has an explosive charge in the warhead end 5 and a propellant charge in the motor end 7. Rocket 10 has an annular retaining ring 12 at the motor end, another like ring 14 at the warhead end and a cylindrical section between. Along ring 12 are four narrow projections 16 and along ring 14 are four broad projections 18. These projections match notches 20 and 22 in reinforcing rings 23 and 25 respectively on fin assembly 24, which is mounted on the rocket so that it can slide from ring 14 to ring 12.

Figure 3:
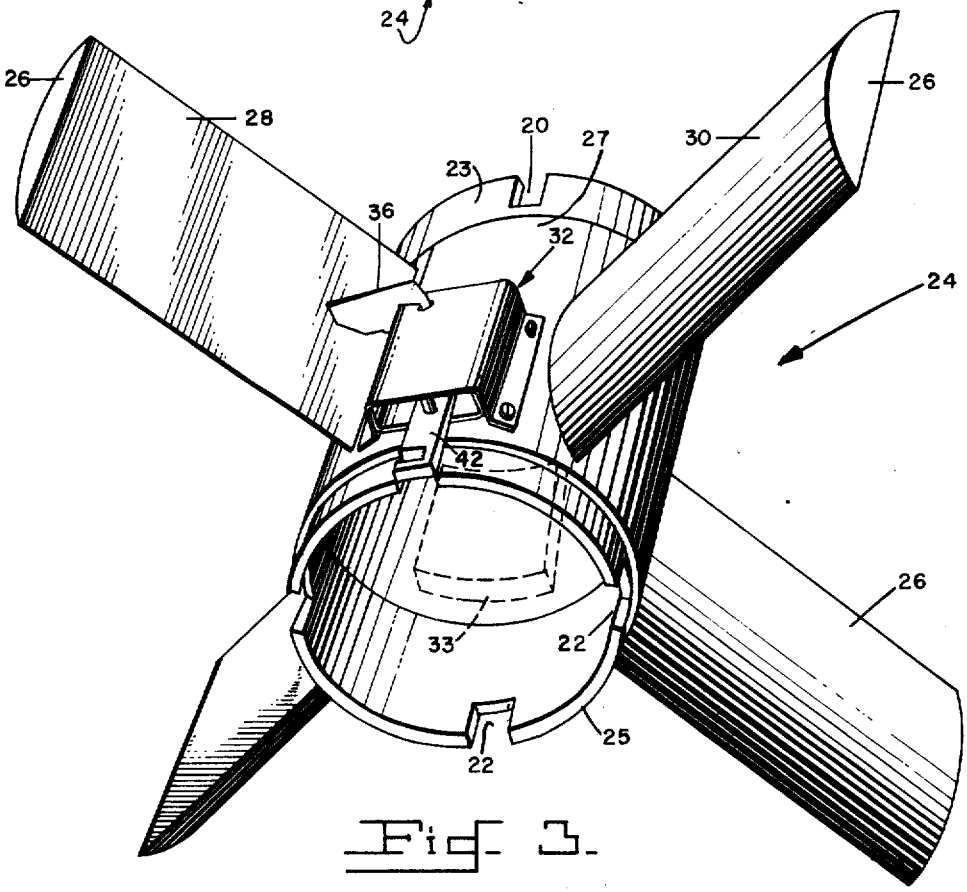
FIG. 3 is a perspective view of the fin assembly.

Fin assembly 24 consists of four fins 26 of airfoil cross section which are asymmetric about the chord. Although these fins could be of single thickness metal formed convex-concave, for reasons of rigidity a fin with one plane surface 28 and one convex surface 30 is preferred. An arcuate camber works well. The fins are symmetrically spaced around a tube 27. On each fin the convex surface is counter-clockwise of the plane surface as viewed in FIG. 3. Also for additional rigidiy reinforcing rings 23 and 25 are provided at each end of tube 27.

A lock 32 is provided to hold the fin assembly at the warhead end 5 of rocket 10 against acceleration forces until the rocket transits to travel in this direction. Although this lock could be responsive to time, we prefer to use an air responsive lock. For aerodynamic reasons either two symmetrically placed locks 32 or one lock and a symmetrically placed dummy 33 are used.

Figure 5:
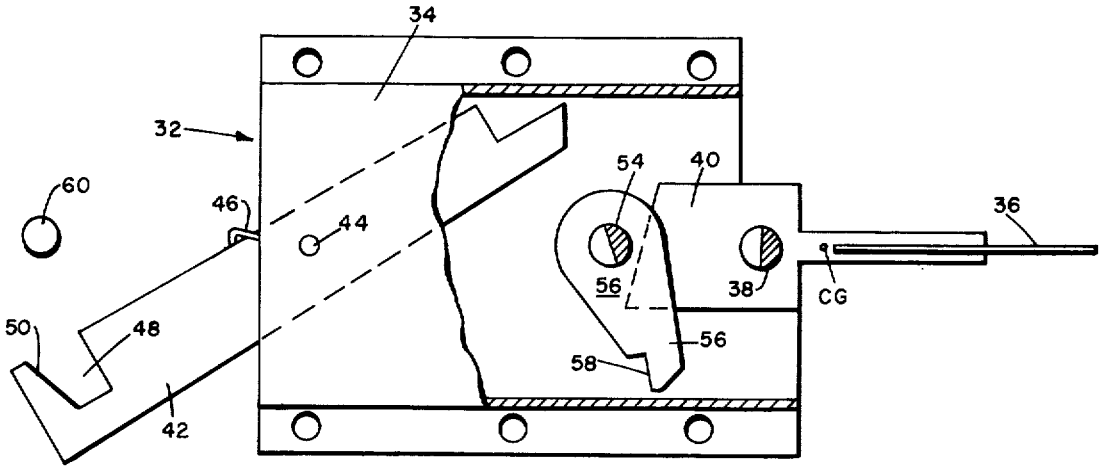
FIG. 5 is a view similar to FIG. 4 in the unlocked position.
Figure 4:
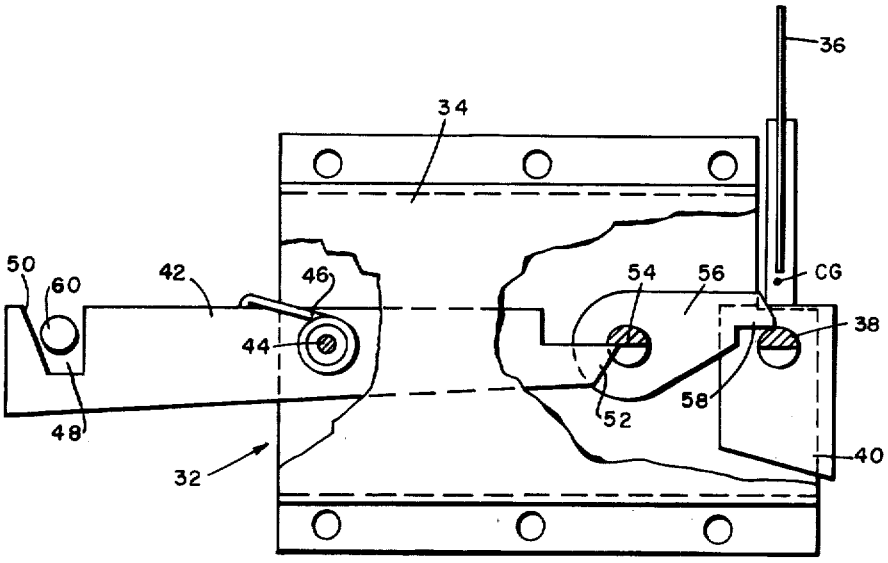
FIG. 4 is a view, partially cut away, of an air lock associated with the fin assembly.

The lock 32 has a housing 34 with an air vane 36 attached to a half-round shaft 38 pivoted at one end of the housing. The vane 36 has counter balance 40 so that its center of gravity is at CG as indicated in FIGS. 4 and 5. At the other end of the housing 34, lock arm 42 is pivoted at shaft 44. Torsion spring 46 biases the lock arm into an open position. At one end of the lock arm is an opening 48 bounded on one side by cam surface 50. The other end of lock arm 42 has a catch 52 which rests against half-round shaft 54 of dog 56. The catch 58 of dog 56 rests on the air vane half-round shaft 38.

In operation the fin assembly 24 is positioned at the warhead end 5 of the rocket 10 with notches 22 mating with projections 18 and lock arm cam surface 50 engaging a projection 60 on the rocket body. When the rocket 10 is fired and launched motor end 7 first, the fins 26 at the warhead end 5 stabilize its flight and the lift of each fin causes it to spin or rotate. When the thrust of the motor causes the rocket to stop and reverse directions, this spin stabilizes the rocket. While the rocket is traveling motor end first, air resistance holds vane 36 in the locked position despite acceleration forces on the center of gravity CG. When the rocket transits from one direction of travel to the other the combination of acceleration force on the center of gravity CG and wind upon vane 36 cause shaft 38 to rotate, releasing dog 56 and lock arm 42. Spring 46 and the acceleration forces working through cam surface 50 cause lock arm 42 to rotate and to become disengaged from projection 60. Fin assembly 24 thereupon slides to the motor end 7 of the rocket 10 as a result of acceleration and wind resistance. Notches 20 mate with projections 16. The rocket is now stabilized by both the fins 26 and the continued spin.

Various modifications readily suggest themselves. For instance, rather than providing a dummy lock the single one could be ejected after unlocking. Or the missile could be rotated by canted vanes in the nozzle and the fins be symmetrical. Or the fins could be symmetrical and no spin at all be applied as the time the rocket is not in motion is very short; however, it is desirable that the rocket be stabilized at all times.

Therefore, it is apparent that the embodiments shown or described are only exemplary and the various other modifications can be made in construction and arrangement within the scope of the invention as defined in the following claims.

We are speaking at all times of rockets with a warhead end and a motor end, the rocket being launched from an aircraft with the warhead end pointed in a direction generally opposite to the direction of motion of the launching site with respect to the air. (It will be understood that the ground, and motion if any of the air with respect to the ground, need not be considered.) Our rockets at all times of interest remain pointed in substantially the same direction in space. Initially the ambient air, as seen by the rocket, is moving past the rocket from motor end to warhead end; this is what we mean when we say that the rocket has been launched motor-first with respect to the air. Subsequently, as a result of the propulsive effect of the rocket's motor, the relative motion of air and rocket reverses — i.e., the rocket, without any substantial change in the direction of its longitudinal axis in space, attains a condition in which the ambient air is moving past the rocket from warhead end to motor end. When this condition exists, we speak of the rocket as moving warhead-first.

We claim:

1. A slidable fin assembly in combination with a rocket adapted to be launched motor-first with respect to the air, said rocket having a motor at one end and a warhead at the other end, said fin assembly comprising a tube encircling the body of said rocket and adapted to be longitudinally slidable thereon, a plurality of fins symmetrically mounted to said tube, each of said fins having an airfoil cross section which is asymmetric about its chord so that the lift of said fins acts to spin the rocket in the same direction about its longitudinal axis whether the rocket is traveling motor-first with respect to the air or warhead-first with respect to the air, said slidable fin assembly being initially located at the warhead end of the rocket so that said fins provide stabilization as the rocket initially travels motor-first with respect to the air, air-responsive lock means adapted to cooperate with said fin assembly and said rocket so that said lock means holds said fin assembly at the warhead end of the rocket while the rocket travels motor-first with respect to the air and unlocks said fin assembly when the thrust of the rocket motor causes the rocket to stop and reverse directions, said fin assembly in response to the aerodynamic forces on said fins thereupon longitudinally sliding to the motor end of the rocket so that the fins now provide stability as the rocket travels warhead-first with respect to the air, and means on said rocket for engaging and maintaining the fin assembly in position at the motor end after sliding thereto, the spin of the rocket caused by the lift of the fins providing stability for both directions of travel of the rocket and also during the period when the rocket is not in motion.

* * * * *